United States Patent [19]

Kleinhäny et al.

[11] Patent Number: 4,603,564

[45] Date of Patent: Aug. 5, 1986

[54] LOCK CYLINDER WITH INTEGRATED ELECTROMAGNETIC LOCKING SYSTEM

[75] Inventors: Arno Kleinhäny, Hinwil; Walter Gutmann, Wetzikon, both of Switzerland

[73] Assignee: Bauer Kaba AG, Wetzikon, Switzerland

[21] Appl. No.: 464,504

[22] PCT Filed: Jun. 15, 1982

[86] PCT No.: PCT/CH82/00078

§ 371 Date: Jan. 31, 1983

§ 102(e) Date: Jan. 31, 1983

[87] PCT Pub. No.: WO82/04459

PCT Pub. Date: Dec. 23, 1982

[30] Foreign Application Priority Data

Jun. 17, 1981 [CH] Switzerland ..... 4006/81

[51] Int. Cl.[4] ..... E05B 47/00

[52] U.S. Cl. ..... 70/277; 70/262; 70/380; 70/421; 70/DIG. 62

[58] Field of Search ..... 70/379 R, 379 A, 380, 70/421, 381, 372, DIG. 62, 277-283; 292/359

[56] References Cited

U.S. PATENT DOCUMENTS

| | | | |
|---|---|---|---|
| 288,512 | 11/1883 | Terry | 292/359 |
| 874,438 | 12/1907 | Rautbord | 70/379 R |
| 1,010,727 | 12/1911 | Corbin et al. | 70/379 R |
| 1,464,315 | 8/1923 | Gates | 292/359 |
| 1,695,518 | 12/1928 | Watson | 70/277 |
| 1,832,108 | 11/1931 | Falk | 70/380 |
| 2,475,220 | 7/1946 | Chaulk et al. | 171/97 |
| 3,599,454 | 8/1971 | Hill | 70/277 X |
| 3,748,878 | 7/1973 | Balzano et al. | 70/218 |
| 3,788,110 | 1/1974 | Sugae | 70/380 X |
| 3,939,679 | 2/1976 | Barker et al. | 70/277 |

FOREIGN PATENT DOCUMENTS

| | | | |
|---|---|---|---|
| 2325566 | 12/1974 | Fed. Rep. of Germany . | |
| 2428130 | 2/1980 | France | 70/421 |
| 2024922 | 1/1980 | United Kingdom | 70/277 |

*Primary Examiner*—Kenneth J. Dorner
*Assistant Examiner*—Lloyd A. Gall
*Attorney, Agent, or Firm*—Roylance, Abrams, Berdo & Goodman

[57] ABSTRACT

A magnetic bolt has a movable and electromagnetically operable locking member which, in conjunction with a locking part arranged on the rotor of a lock cylinder, blocks or releases the rotor, independently of the mechanical tumblers depending on whether the locking member is located in a free-running slot or a locking notch of the locking part. The magnetic bolt is arranged in a recess in the lock cylinder stator and provides an electromagnetic locking operation by energizing a field coil.

5 Claims, 6 Drawing Figures

LOCK CYLINDER WITH INTEGRATED ELECTROMAGNETIC LOCKING SYSTEM

FIELD OF THE INVENTION

The present invention relates to a security lock cylinder with a mechanical tumbler located in the cylinder and an electromagnetic tumbler. The mechanical tumbler is opened by the associated key, while the electromagnetic tumbler is opened by external actuation.

BACKGROUND OF THE INVENTION

Combinations are known in which a mechanical locking system, operated by mechanical means, cooperates with a mechanical locking system operated by electromagnetic means. Conventional practice employs the mechanical means for opening a closure in situ, e.g. by means of a door knob, door latch, key, etc., while the electromagnetic means is used for operating the same closure from a distance.

For example, the independent positioning of the place to actuate or manipulate the electromagnetic means permits central monitoring of remote closure systems in part. This monitoring can take place in a fully automatic time-dependent manner by the action of an operator, by imposing predetermined states, etc.

It is generally an additional closure means, i.e. additional to the mechanical means, which is used in a conjunctive or disjunctive manner. These conjunctive and disjunctive possibilities extend the use of closure systems, particularly from an organizational standpoint. For example, this is shown by the truth table to be used in this connection, e.g., relative to a door:

| Mechanical | Electromagnetic | |
|---|---|---|
| 0 | 0 | Door open for everyone |
| 1 | 0 | Access only to key holders |
| 0 | 1 | Access allowed from control center |
| 1 | 1 | Control center allows access for certain key holders. |

The organizational possibilities are extended by the two alternatives of key or control center. Security is increased by the conjunctive possibility of key and control center.

The advantages of such combined closure systems are, for example, described and used in DOS No. 2,325,566. The mechanical means for actuating the closure, specifically a door closure, are turning handles or knobs arranged on the door for sliding a bolt. The electromagnetic means actuate an additional bolt, which locks or releases as a function of the main bolt position. A security cylinder is provided for the actuation or release of the electromagnetically operated additional bolt, with the security cylinder being associated in an interrogating device. The electromagnetic part is housed in the door frame, as is the safety cylinder releasing the electromagnetic means. The security cylinder only operates the electromagnetic locking system with the aid of a specially machined serrated or notched bit key, the back of which contains the information for the reading device. Electromagnetic release can also take place disjunctively, i.e. in a key or control center form.

Page 158 of the Journal "Baubeschlag Magazin" No. 10/80, October 1980, describes another solution for the combined closure system. The main bolt is blocked by an additional bolt operable by electromagnetic means. The additional mechanical locking system manipulated by a safety cylinder and using a key, is housed together with the electromagnetic means in the door lock box, i.e. not separately in the door and the frame. The lock bolt is blocked in the rear bolt part and not in the front bolt part.

A special construction of the closure means is required for blocking a bolt acting, e.g., between the door and the door frame, either by means of a device in the frame or a device in the door. To subsequently provide an electromagnetic additional closure means in an existing closure of a random type, but particularly on doors, it is necessary to carry out modifications in the mechanical part of the lock. This preferably involves the replacement of an existing lock by a lock for the electromagnetic additional locking system, or which has already been manufactured with this system.

This replacement naturally involves high costs, because otherwise intact locking mechanisms must be completely replaced. This often involves additional modification expenditure on the existing door or door frame. Thus, the additional security is often not utilized, particularly if it is necessary to modify a large number of closure systems.

SUMMARY OF THE INVENTION

An object of the present invention is to provide a completely independent unit with mechanical and electromagnetic locking means, which can be installed simply by replacement in an existing locking system of standardized dimensions. This replacement can be accomplished without modifying the area about the lock.

Another object of the present invention is to construct an independent unit such that it acts on one of the two sides (door sides) separated by the closure, or simultaneously on both sides (door sides) separated by the closure or with a different effect on each of the two sides (door sides) separate by the closure.

The foregoing objects are obtained by a lock cylinder stator with a recess, an electrically operable bolt arranged in the recess, and a locking mechanism acting between the lock cylinder stator and the lock cylinder rotor.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 4' is a perspective view of the locking part removed from the rotor end.

DETAILED DESCRIPTION OF PREFERRED EMBODIMENTS

Figure 1:
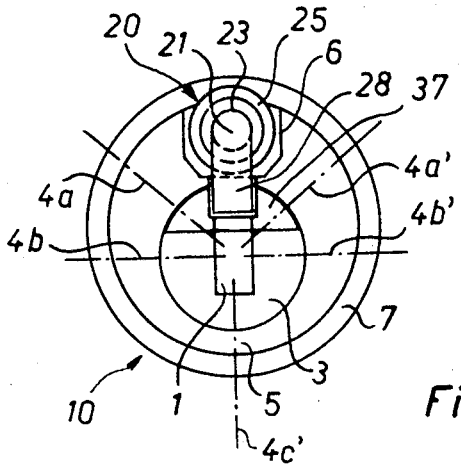
FIG. 1 is a front elevational view of a lock cylinder with mechanically operable tumblers and with an electromagnetically operable tumbler which cooperates with the lock cylinder in accordance with the present invention.
Figure 5:
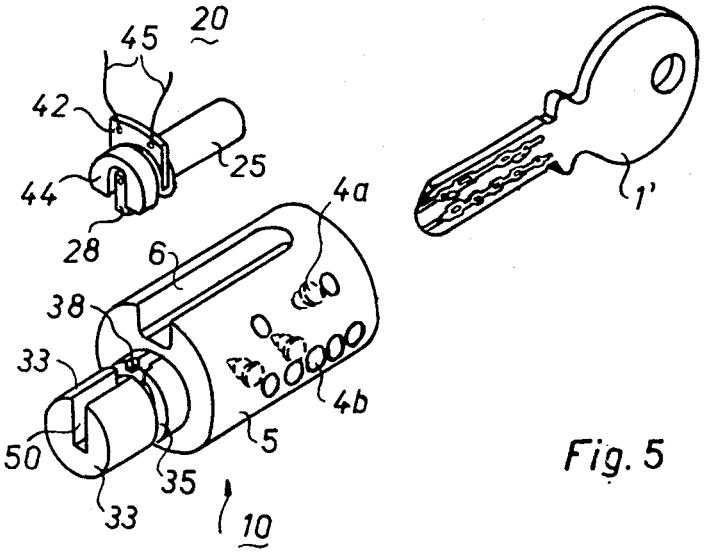
FIG. 5 is an exploded perspective view of a lock cylinder with a key according to the present invention.

FIG. 1 illustrates the face of lock cylinder 10, relative to the three-dimensional view of FIG. 5, in the rear part of the lock cylinder which projects into the lock mechanism.

The cylinder sleeve 7, defining the lock cylinder, has an external circumference corresponding to standardized dimensions. Thus, the lock cylinder according to the invention can be introduced into a conventionally constructed lock, either by replacement, e.g. if an existing closure system is to made additionally lockable, or by constructing new closure systems in which the electromagnetic additional locking device is to be provided. Thus, conventional and widely used lock systems can be employed without modification.

The stator 5 is arranged within cylinder sleeve 7 and has radial bores for the mechanical tumblers to be operated by the key. These mechanical tumblers are merely indicated by the tumbler planes. The tumbler planes inclined, e.g. by 45° to the main plane of the key are designated 4*a* and 4*a'*, and those inclined by 90° are designated 4*b* and 4*b'*. In addition, a tumbler plane 4*c'* coplanar with the main plane of the key is provided. A rotor 3 has a key channel end coinciding with lever slot 50 (FIG. 5), as well as a locking part or element 37 arranged so as not to rotate relative to rotor 3. Locking part 37 engages a locking member 28 on armature 21, if the magnetic action brings the armature into one of two provided positions.

Armature 21 is part of the complete electromagnetic bolt 20 housed in an axially directed slot 6 in stator 5. Slot 6 for receiving the magnetic bolt is covered by the cylinder sleeve 7 and is simultaneously subjected to pressure so that magnetic bolt 20 is substantially secured against rotation and axial displacement. Various measures can be taken to secure the position of the magnetic bolt in the stator slot, including use of the partial flange 44 on magnetic bolt 20 (FIG. 5), the carrier plate 42 for the electrical leads 45 for operating the magnetic winding of the bolt, or both such elements together.

Figure 2:
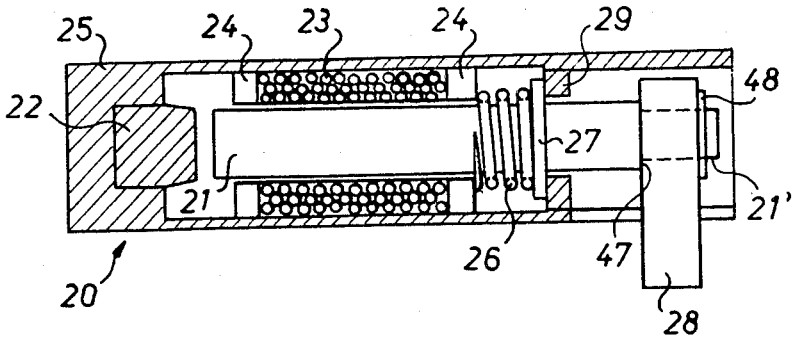
FIG. 2 is a side elevational view in section of the electromagnetically operable bolt of FIG. 1.

The detailed construction of the magnetic bolt is illustrated in FIG. 2. A cylindrical casing 25 is preferably adapted to the slot shape and surrounds the electrical and magnetic bolt parts. The former 24 carrying out the field coil 23 is inserted and fixed in the bolt casing. The soft iron armature 21 passing through the inner part of coil 23 has a retaining washer 27 fixed at approximately a third point of its length. This washer is sufficiently large that it acts as a longitudinal movement limiter against the stop member 29 arranged at the casing end. A pressing helical spring 26 acting between former 24 and retaining disk 27 brings armature 21 into a clearly defined position relative to casing 25 and consequently relative to lock cylinder rotor 3.

The magnetic field produced by the energized winding draws armature 21 counter to the tension of the pressing spring 26 against armature stop 22. Simultaneously locking member 28 located on the extension of the active armature part is retracted. The reciprocating movement of locking member 28 is used, through engagement of locking member 28 in locking part 37 fixed to rotor 3, for securing or releasing the rotor for rotary movement.

In its front part which carries locking member 28, armature 21 is stepped to a smaller radius. A stop 47 is formed at the transition 21, 21' of the different radii and, in conjunction with retaining washer 48, ensures a secure seating of locking member 28.

Figure 3:
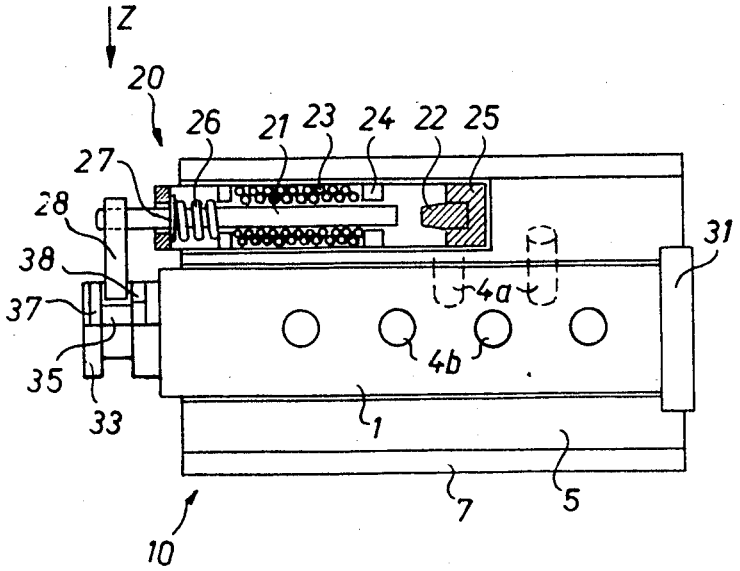
FIG. 3 is a side elevational view in section of the lock cylinder of FIG. 1.

The cooperation of lock cylinder 10 with magnetic bolt 20 or the cooperation of magnetic bolt 20 with rotor 3 is shown in FIG. 3. Magnetic bolt 29 (shown in FIG. 2) is fixed in slot 6 in stator 5. The front part of the lock cylinder has an entrance flange 31 for key channel 1, this side being accessible to the key from the outside. The opposite side is located within the lock and carries the electrically operable locking means with the locking part 37, locking notch 38 and peripheral free-running slot 35. Together, this entity also forms rotor end 33. Certain of the tumblers 4, shown in FIG. 1, are depicted by the tumbler planes.

Locking member 28 projects into free-running slot 35 such that rotor 3 can be rotated about its axis by the key belonging to the lock cylinder following opening of the mechanical tumblers. By a lock operator inserted in lever slot 50 (FIG. 5), this rotary movement is transferred to the lock opening mechanism.

As a result of the live coil 23, armature 21 with the locking member 28 fixed thereto is axially retracted relative to rotor 3 such that locking member 28 enters locking notch 38. The rotor is then locked and cannot be opened despite an attempt to operate it with the correct key, i.e., the key associated with the security cylinder. In this arrangement, the dead inoperative condition of the coil releases the rotor, i.e., the magnetic bolt must be energized for locking purposes. By interchanging the locking notch and the free-running slot, this action can be reversed so that the lock cylinder can be locked with the coil deenergized.

Figure 4:
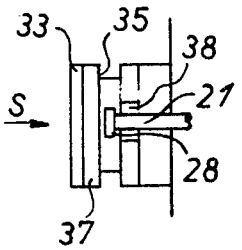
FIG. 4 is a top plan view of the bolt part viewed in direction Z in FIG. 3.
Figure 4:
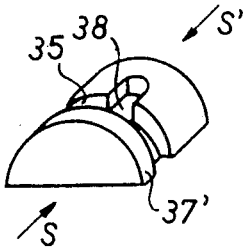

FIG. 4 shows, in detailed form, the end of rotor 3 from locking member 28, i.e. from above the bolt part in FIG. 3 in direction Z. Locking member 28 is in free-running slot 35 opposite to locking notch 38 in locking part 37, forming the outer position. On displacing the armature in the direction of arrow S, locking member 28 locks the rotor end 33 by engaging locking notch 38 and consequently prevents the rotor 3 from rotating.

To provide the locking condition in the dead state without modifying or replacing part of the equipment, locking part 37 is constructed according to FIG. 4'. Locking part 37' can be removed from the rotor end 33 and is dimensioned in such a way that the circumferentially juxtaposed segments carry on the one hand the free-running slot 35 and on the other hand the locking notch 38, and have the same longitudinal dimensions. As a result of the symmetry obtained, locking part 37' can be turned into the position S' relative to rotor end 33 and simultaneously the position of the free-running slot 35 is interchanged with that of the locking notch 38. In the dead state, armature 21 maintains locking member 28 in locking notch 38. By switching on the current for energizing field coil 23, locking member 28 is drawn from the locking notch 38 into the free-running slot 35. After opening the mechanical tumblers 4, the rotor can then be freely rotated. This is the condition for the unlocking of the closure system.

The complete arrangement of magnetic bolt 20, lock cylinder 10, rotor end 33 and the corresponding key is shown in FIG. 5. With respect to the closure means, it is only possible to see one lock cylinder 10 of a lock. If the lock is to be opened from both sides of a door, it is necessary to provide a further lock cylinder, oppositely directed to the illustrated cylinder. Both are in a position to operate the common lock and both have mechanical tumblers associated with the corresponding key.

The continuance of the mechanical action of rotor 3 rotating about its longitudinal slot occurs through the action of a lock operator in lever slot 50 located at the rotor end. Appropriately, this lever slot is merely the extension of the key channel 1 in rotor 3 beyond rotor end 33. The free-running slot 35 is cut and crossed at right angles. Locking notch 38 is longitudinally cut.

This simplifying measure requires that locking part 37 be integrated in one part in rotor end 33, because the traversed key channel would cut the locking part 37', according to FIG. 4, into two halves.

The carrier plate 42 for the electrical leads 45 arranged at one end of magnetic bolt 20, is arranged outside cylinder sleeve 7 and only projects over the radius of the latter. As indicated hereinbefore, plate 42 can be used for securing magnetic bolt 20 in stator 5. However, it is even more advantageous to use an engagement of partial flange 44 to the rotor end 33 or a shape of magnetic bolt casing 25 adapted to the axial slot 6 in stator 5.

It is possible to equip only one of the two door sides with a lock cylinder according to the present invention. In this manner, an authorized person is let in by means of magnetic bolt operation activated from a control center, but can at any time pass through the same door from the inside to the outside without magnetic bolt operation. Conversely, the key holder can obtain access at any time but to get out again, he must operate the magnetic bolt. In principle, this can be obtained by the following relationship:

| Door | In | Out | |
|---|---|---|---|
| 1. | M | M | Magnetic bolt to be operated for entry and exit. |
| 2. | O | M | Only exit must be requested |
| 3. | M | O | Only entry must be requested |
| 4. | O | O | Key adequate for entry and exit. |

This also illustrates an advantage of the invention. An existing closure system can be correspondingly conditioned by merely replacing either one or both lock cylinders, thereby improving its control and security aspects. The corresponding leads can easily be passed through passages in the door hinge from the door into the frame, such measures being well known.

While various embodiments have been chosen to illustrate the invention, it will be understood by those skilled in the art that various changes and modifications can be made therein without departing from the scope of the invention as defined in the appended claims.

We claim:

1. A cylinder lock with integrated and independently operable mechanical and electromagnetic locking mechanisms, comprising:

a cylinder housing with a recess defining a main medium plane through a longitudinal axis of said recess;

a solenoid mounted in said recess and having an axially movable, electromagnetically operated armature and a locking member extending from an end of said armature;

a rotor mounted in said housing;

locking means, non-rotatably mounted on said rotor and selectively engagable with said locking member, for permitting or preventing rotation of said rotor in said housing, said locking means including a peripheral free-running slot which receives said locking member to permit rotation of said rotor, and a locking slot which receives said locking member to prevent rotation of said rotor; and mechanical tumbler means, mounted in said housing in longitudinal medium planes and releasably engagable with said rotor in response to a key, for permitting or preventing rotation of said rotor in said housing independently of said solenoid, said longitudinal medium planes being located at equal angles on opposite sides of said main medium plane.

2. A cylinder lock according to claim 1 wherein said solenoid comprises a coil, said locking member being in said free-running slot when said coil is deactivated and being in said locking slot when said coil is activated.

3. A cylinder lock according to claim 1 wherein said locking means comprises a locking element removably and reversibly mounted on said rotor and dimensioned such that relative positions of said slots can be reversed to reverse the effect of solenoid operation by rotating said locking element 180° about an axis perpendicular to a longitudinal axis of said rotor.

4. A cylinder lock with integrated mechanical and electromagentic locking mechanisms, comprising:

a cylinder housing with a recess;

a solenoid mounted in said recess and having an axially movable, electromagnetically operated armature and a locking member extending from an end of said armature;

a rotor mounted in said housing;

locking means non-rotatably mounted on said rotor and selectively engagable with said locking member for permitting or preventing rotation of said rotor in said housing, said locking means including a locking element reversibly mounted on said rotor, said locking element having a peripheral free-running slot which receives said locking member to permit rotation of said rotor and a locking slot which receives said locking member to prevent rotation of said rotor, said slots and said locking element being dimensioned such that relative positions of said slots can be reversed to reverse the effect of solenoid operation by rotating said locking element 180° about an axis perpendicular to a longitudinal axis of said rotor; and mechanical tumbler means, mounted in said housing and releasably engagable with said rotor in response to a key, for permitting or preventing rotation of said rotor in said housing.

5. A cylinder lock with an electromagnetic locking mechanism, comprising:

a cylinder housing;

a solenoid coupled to said housing and having an axially movable, electromagnetically operated armature and a locking member extending from an end of said armature;

a rotor mounted in said housing; and locking means non-rotatably mounted on said rotor and selectively engagable with said locking member for permitting or preventing rotation of said rotor in said housing, said locking means including a locking element reversibly mounted on said rotor, said locking element having a peripheral free-running slot which receives said locking member to permit rotation of said rotor and a locking slot which receives said locking member to prevent rotation of said rotor, said slots and said locking element being dimensioned such that relative positions of said slots can be reversed to reverse the effect of solenoid operation by rotating said locking element 180° about an axis perpendicular to a longitudinal axis of said rotor.

* * * * *